US005419397A

United States Patent [19]

Reynolds et al.

[11] Patent Number: 5,419,397

[45] Date of Patent: May 30, 1995

[54] WELL CLEANING TOOL WITH SCRATCHING ELEMENTS

[75] Inventors: J. Scott Reynolds, Aberdeen, Scotland; Robert L. Sloan, Katy, Tex.

[73] Assignee: Well-Flow Technologies, Inc., Houston, Tex.

[21] Appl. No.: 78,542

[22] Filed: Jun. 16, 1993

[51] Int. Cl.[6] ..... E21B 37/02; E21B 37/06

[52] U.S. Cl. ..... 166/312; 166/173; 166/311

[58] Field of Search ..... 166/173, 174, 170, 171, 166/176, 177, 311, 312; 15/104.16, 104.2

[56] References Cited

U.S. PATENT DOCUMENTS

| | | | |
|---|---|---|---|
| 1,342,618 | 6/1920 | Bashara . | |
| 1,392,105 | 9/1921 | Bergesen, Sr. . | |
| 1,598,771 | 9/1926 | Gerhardt . | |
| 1,713,895 | 5/1929 | Ford . | |
| 1,855,046 | 4/1932 | Gerhardt . | |
| 2,190,145 | 2/1940 | Braden | 166/174 |
| 2,334,788 | 11/1943 | O'Leary | 166/173 X |
| 2,392,144 | 1/1946 | Hall | 15/104.06 |
| 2,447,966 | 8/1948 | Stephens | 15/104.06 |
| 2,509,922 | 5/1950 | Hall . | |
| 2,567,475 | 9/1951 | Hall . | |
| 2,695,673 | 11/1954 | Coyle | 166/170 |
| 2,715,552 | 8/1955 | Lane . | |
| 3,176,772 | 4/1965 | MacGregor | 166/173 |
| 3,541,628 | 6/1968 | Girard | 15/104.06 |
| 3,827,492 | 8/1974 | Hammon et al. | 166/173 |
| 4,164,980 | 8/1979 | Duke | 166/291 |
| 4,345,350 | 8/1982 | Burd | 15/104.06 R |
| 4,427,065 | 1/1984 | Watson | 166/250 |
| 4,438,812 | 3/1984 | Hammon | 166/173 |
| 4,501,322 | 2/1985 | Martin | 166/173 |
| 4,548,271 | 10/1985 | Keller | 166/291 |
| 4,612,986 | 9/1986 | Fosdick, Jr. et al. | 166/312 X |
| 4,747,452 | 5/1988 | Clark | 166/311 |
| 4,809,779 | 3/1989 | Ledyashov et al. | 166/173 |
| 4,896,720 | 1/1990 | DeRouen | 166/170 |

FOREIGN PATENT DOCUMENTS

| | | |
|---|---|---|
| 225145 | 6/1987 | European Pat. Off. . |
| 727621 | 4/1955 | United Kingdom . |

OTHER PUBLICATIONS

Bowen, Sales literature entitled "Bowen Tubing Casing Scrapers" (1986–87 Composite Catalog of Oil Field Equipment and Services, p. 555, vol. 1, 37th Revision; World Oil).

OM, Sales literature entitled "OM Casing Scraper" (1986–89 Composite Catalog of Oil Field Equipment and Services, p. 5158, vol. 4, 37th Revision; World Oil).

HOMCO, Sales literature entitled "Casing Patches" (1986–87 Composite Catalog of Oil Field Equipment and Services, p. 2691, vol. 2, 87th Revision; World Oil).

Grant Oil Tool Company, Sales literature entitled "Casing Scraper Models 5500, 5600" (1986–87 Composite Catalog of Oil Field Equipment and Services, p. 2346, vol. 2, 87th Revision; World Oil).

A–Z, Sales literature entitled "Hole Opener Casing Scraper" (1986–87 Composite Catalog of Oil Field Equipment and Services, p. 157, vol. 1, 87th Revision; World Oil).

BCW, Sales literature entitled "BCW Casing Scraper" (1986–87 Composite Catalog of Oil Field Equipment and Services, p. 290, vol. 1, 87th Revision; World Oil).

PCT International Search Report, dated Oct. 28, 1994.

*Primary Examiner*—Stephen J. Novosad

*Attorney, Agent, or Firm*—Margaret A. Boulware

[57] ABSTRACT

A tool for cleaning oil, gas, and water well wall casing is disclosed. The cleaning tool includes a cylindrical member and a helical swath of scratching elements affixed to the side walls of the cylindrical member positioned for scouring the interior wall of the casing. Also included in the side walls of the cylindrical member is a helical channel adjacent to the swath of scratching elements. Typically, a workstring maneuvers the tool through the casing under mechanical force. Fluid is circulated through the channel of the tool to carry to the surface the loosened debris scoured from the interior wall of the casing. A method of cleaning a well casing is also disclosed. The method includes the use of a tool with scratching elements and flow channels, which tool can be used either with or without cleaning solvents.

21 Claims, 4 Drawing Sheets

WELL CLEANING TOOL WITH SCRATCHING ELEMENTS

BACKGROUND OF THE INVENTION

1. Field of the Invention

This invention pertains to well cleaning tools such as those employed in oil, gas, or water well cleaning operations and more specifically to such tools having a plurality of small scratching elements for independently removing debris from the interior surface of well casings or used in combination with solvents for such purposes.

2. Description of the Prior Art

Oil, gas, water, and other types of wells almost always use casing, a steel pipe, to ensure the integrity of a well borehole. The casing wall is cemented during the completion stage of a drilling operation. This cementing operation leaves cement residue on the casing wall which must be removed before initiating well production. Cleaning of the casing wall is also necessary at intervals during well production when debris and residue, such as oil paraffin and scale, accumulate on the casing wall.

The standard tools used for cleaning casing walls are referred to as casing scrapers and are well known in the art. A typical casing scraper is incorporated in a "plug" and usually incorporates metal blades attached to an elongated body. The blades scrape the casing wall as a hydraulic or mechanical force displaces the body through the casing. A disadvantage of plug-scrapers propelled by hydraulic force is that the scrapers and the debris scoured from the casing wall are not retrievable. The scrapers and debris are displaced to a point past the formation of interest where they remain to clutter the well borehole.

Alternatively in the prior art, a scraper is mounted onto a tool that is attached to the workstring for mechanical manipulation and retrieval once the cleaning operation has been completed. However, a drawback of such scraper tools is that the blades often shear off during cleaning, and a high cost fishing job is required to remove the lost component from the well. Another disadvantage exists in the fact that many common casing scrapers do not achieve 360 degree contact with the casing wall unless they are rotated during the cleaning process. This rotation increases the probability of blades being sheared off the body.

An example of a casing scraper that ameliorates many of these deficiencies of the current technology is disclosed in U.S. Pat. No. 4,896,720. This form of a plug-scraper employs bristles rather than blades, and the entire tool is constructed of easily drillable materials. Therefore, the need for expensive fishing jobs is eliminated. However, neither the tool nor the debris scoured from the casing wall is retrievable under the disclosure in U.S. Pat. No. 4,896,720. Other bushing tools utilizing bristles have been developed. Examples of such tools are disclosed in U.S. Pat. Nos. 1,342,618, 1,855,046, 3,827,492, 4,438,812, 4,501,322, and 4,747,452. Most of these brushing tools are not used in the well cleaning industry because the brushes are not sufficiently stiff nor do they contact the casing wall with sufficient pressure to achieve the same extent of scouring as the scrapers.

SUMMARY OF THE INVENTION

The instant invention comprises an improved method and apparatus for cleaning the interior wall of a well casing after cementing the casing or when debris has accumulated on the casing wall.

Generally, the proposed well cleaning tool is connectable to a workstring which mechanically drives the tool through the casing. The tool comprises an elongated, generally cylindrical member and a helical swath of scratching elements affixed to the side walls of the cylindrical member. The member includes side walls that are resiliently compressible to allow insertion of the tool into the casing. The side walls also serve to exert a radially outward pressure on the scratching elements against the interior wall of the casing. The outside diameter of the member is larger than the inside diameter of the casing wall. The helical swath of scratching elements form a scouring surface positioned for contacting the entire 360 degree interior wall of the casing as the workstring is lowered or raised. The side walls also include a helical channel adjacent to the swath of scratching elements such as to allow fluid circulating through the member to flow between the member and the interior wall of the casing and to carry to the surface the loosened debris scoured from the interior wall of the casing.

A more specific description of the cleaning tool comprises an elongated, cylindrical rigid sleeve, a resilient jacket surrounding the sleeve, and a helical swath of steel bristles. The jacket is constructed of a resiliently compressible material in order to allow insertion of the tool into the casing. The jacket is preferably constructed of foam. The compressibility of the jacket also serves to exert a radially outward pressure on the bristles against the interior wall of the casing. The jacket is designed to have an outside diameter larger than the inside diameter of the casing. The helical swath of steel bristles form a scouring surface positioned for contacting the interior wall of the casing. The surface of the jacket includes a helical channel adjacent to the swath of steel bristles such as to allow fluid circulating through the sleeve to flow between the jacket and the interior wall of the casing and to carry to the surface the loosened debris scoured from the interior wall of the casing.

The tool may be connectable to the workstring through the use of a mandrel, locking collar and top-sub. The mandrel, which is adaptable for connection to the workstring, extends through the entire length of the sleeve. The locking collar is affixed to one end of the mandrel and locks into one end of the sleeve, which ensures that the sleeve does not rotate with respect to the mandrel. The top-sub is affixed to the second end of the mandrel and abuts against the second end of the sleeve, which ensures that the sleeve does not translate with respect to the mandrel.

The fact the that the tool is attached to a workstring allows it to have the feature of being retrievable.

Another feature of the instant invention is to provide for improved cleaning by the combination of fluid circulation and scouring with scratching elements. Fluid circulation through the channels in the tool causes debris scoured from the casing walls to flow to the surface for removal. Therefore the debris is completely removed from the well.

Another feature of the instant invention is the elimination of the need for expensive fishing jobs to remove lost components of a well cleaning tool. The jacket is constructed of easily drillable materials so that a portion torn from the jacket may be drilled out with a conventional drill bit or milling tool.

Another feature of the instant invention is to provide for improved contact between the scratching elements and the interior wall of the casing. The tool makes 360 degree contact with the casing wall during the cleaning process whether it is rotated or not. Also, the resiliency of the jacket presses the scratching elements against the surface of the interior wall of the casing.

Various other advantages, features, and characteristics of the instant invention will be evident upon reading of the following description.

Figure 3:
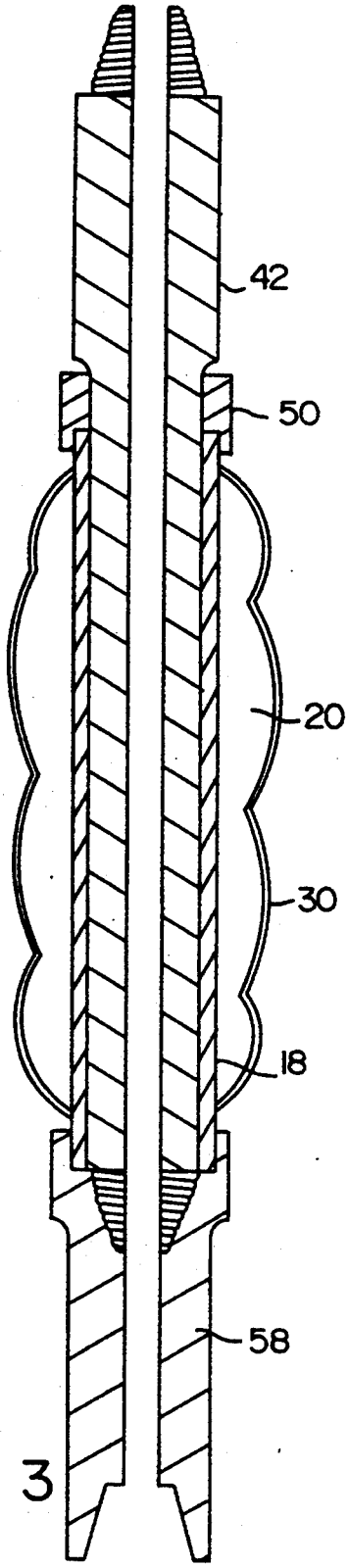
Figure 4:
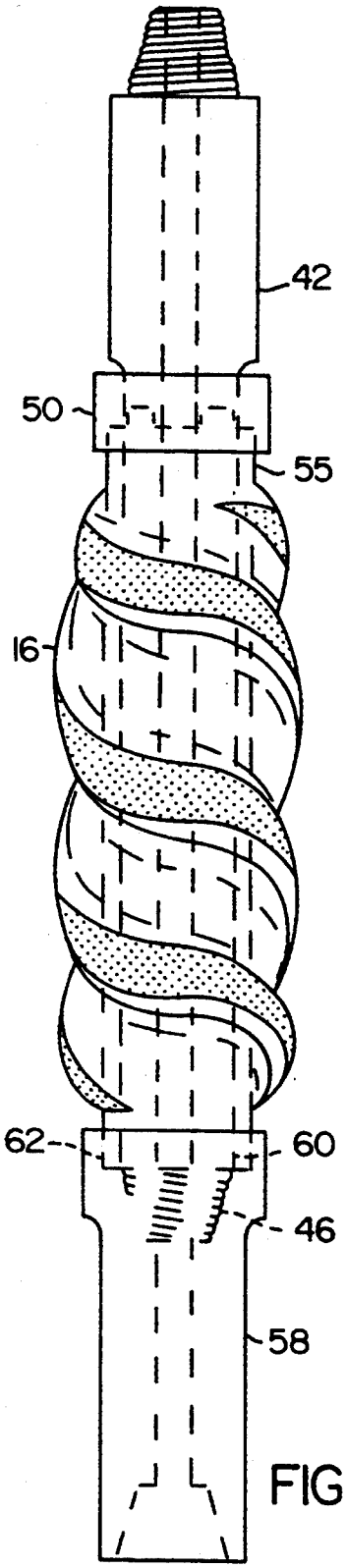
Figure 5A:
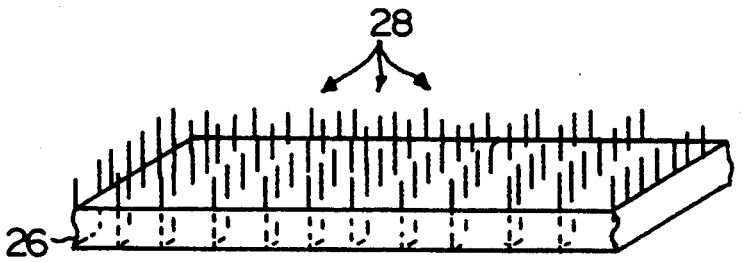
Figure 5B:
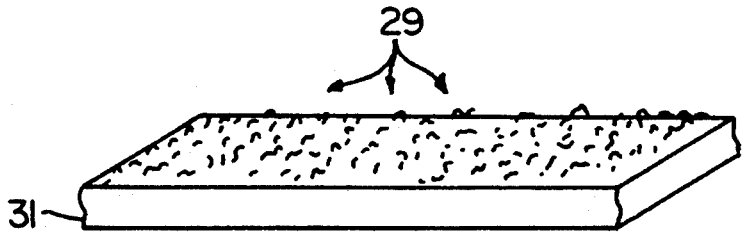

FIG. *2a* is a vertical view in schematic form of the mandrel and looking collar;

FIG. *2b* is a vertical view in schematic form of the jacket and sleeve;

FIG. *2c* is a vertical view in schematic form of top-sub;

FIG. 3 is a vertical section view in schematic form of the present invention;

FIG. 4 is a vertical view in schematic form of the structural relationship of the components illustrated in FIG. *2a–c*;

FIG. *5a* is a side section of the fabric backing with steel bristles as scratching elements;

FIG. *5b* is a side section of the fabric backing with tungsten chips as scratching elements.

DESCRIPTION OF THE PREFERRED EMBODIMENTS

In the description that follows, the drawing figures are not necessarily to scale and are in somewhat schematic form.

Figure 1:
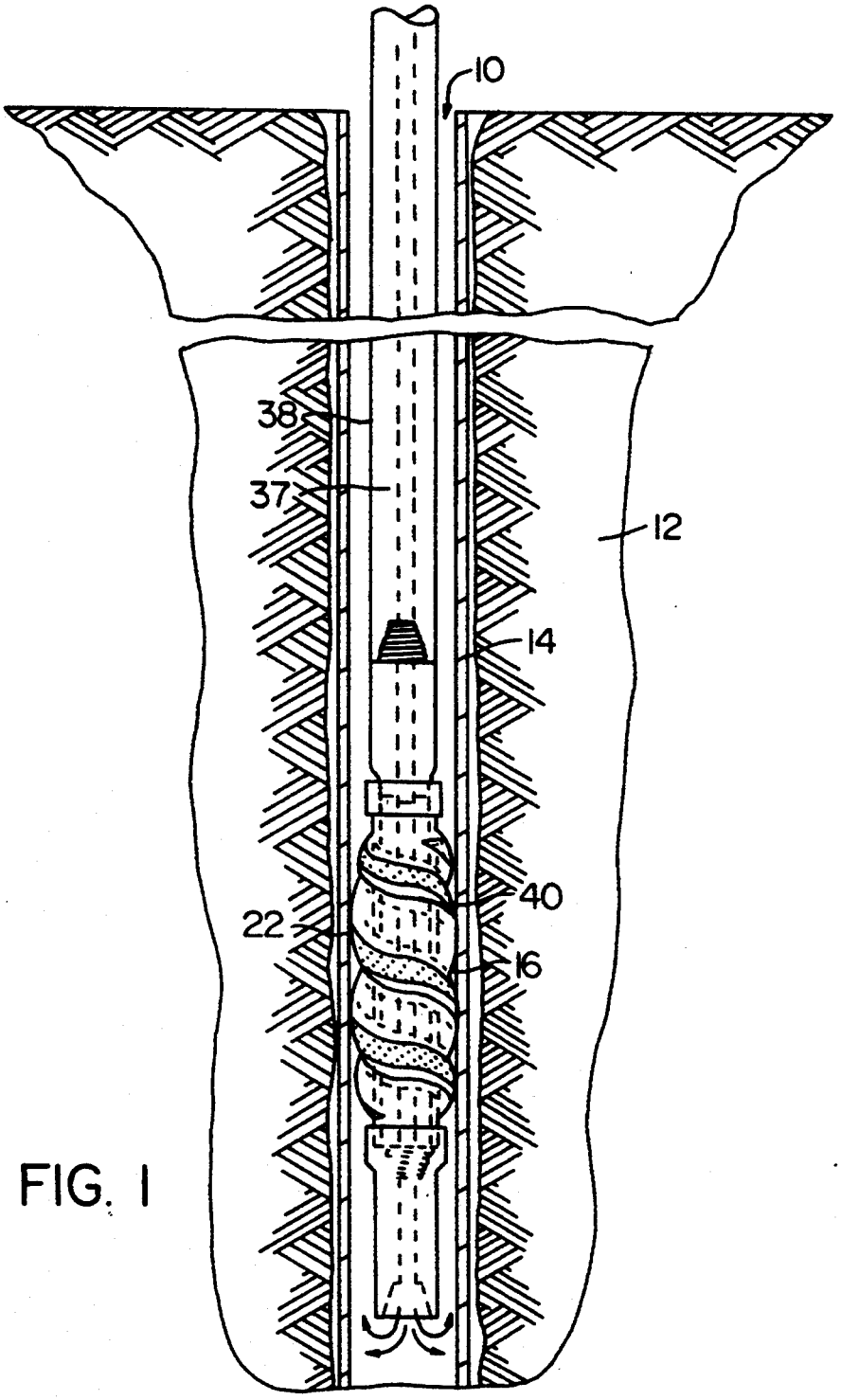
FIG. 1 is a vertical section in schematic form of an oil well with casing of which the tool of the present invention is cleaning.
Figure 2A:
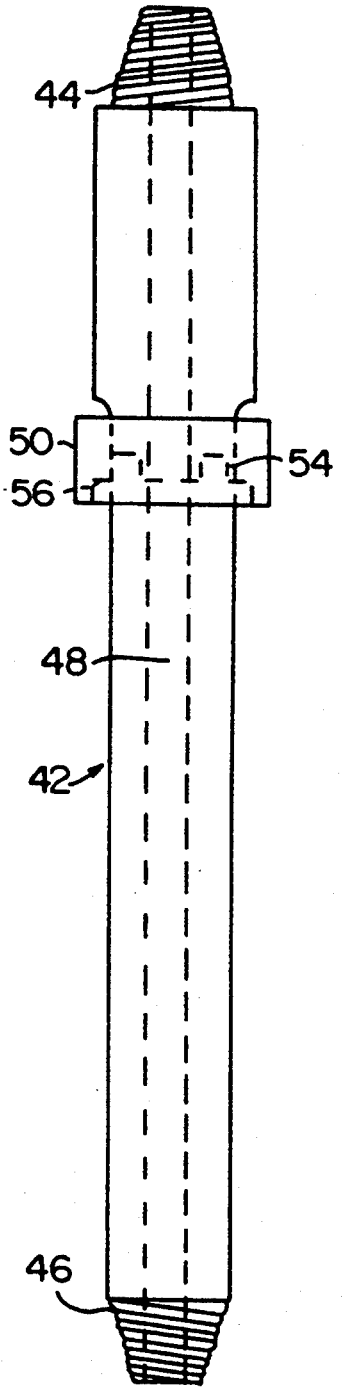
Figure 2B:
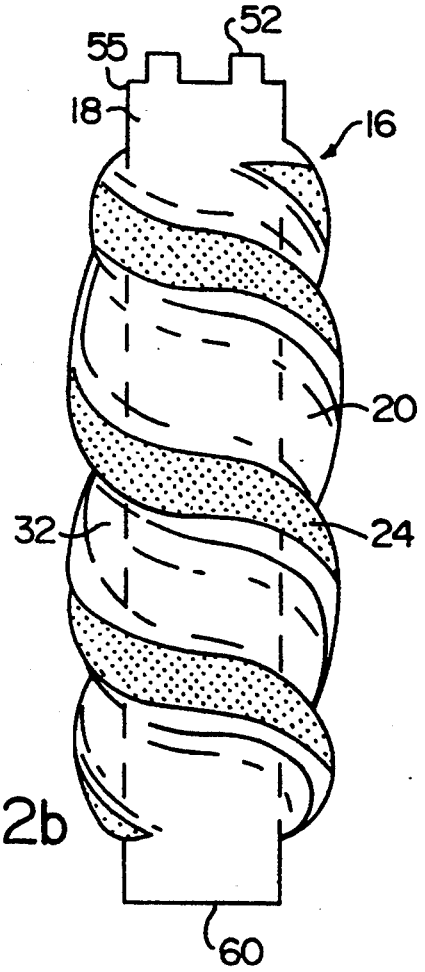
Figure 2C:
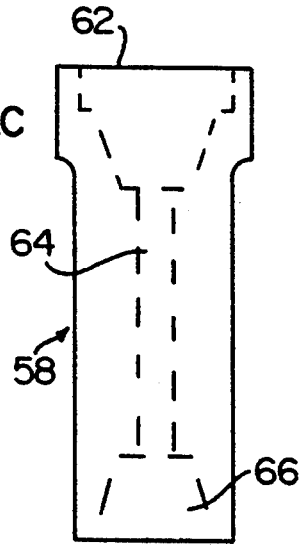

Referring to FIG. 1, well borehole 10 has been drilled into earth formation 12. Casing 14, which has been run the length of well borehole 10 and cemented, is to be cleaned by tool 16 of this invention. Referring to FIG. *2b*, tool 16 preferably includes cylindrical metal sleeve 18 which provides a reinforcing support and a mounting surface for resilient jacket 20. Jacket 20 surrounds and is mounted to sleeve 18. The outside diameter of the jacket is larger than the inside diameter of the casing. Therefore, the jacket must be constructed of foam-like material which is resiliently compressible to allow insertion into the casing. The resiliency of the jacket exerts a radially outward pressure against interior wall 22 of the casing. While the preferred embodiment employs a jacket with an outside diameter larger than the inside diameter of the casing, the jacket can be constructed such that it has an outside diameter equal to the inside diameter of the casing although the outward pressure exerted by the jacket on the casing walls would be minimal.

As shown in FIG. *2b*, tool 16 additionally includes helical swath of steel bristles 24 mounted circumferentially about jacket 20. As shown in FIG. *5a*, the helical swath includes fabric backing strip 26 and a plurality of individual steel bristles 28 inserted into fabric backing strip 26. Preferably, the bristles are similar to U-shaped staples inserted through a heavy canvass fabric backing. Referring to FIG. 1, the bristles are positioned so as to form a scouring surface which contacts casing wall 22. The outward pressure exerted by jacket 20 forces the bristles against the casing wall so that effective scouring is realized during the cleaning process. An alternative embodiment of the scouring, surface shown in FIG. *5b*, employs chips 29, made of such material as tungsten, set in fabric backing 31. This scouring surface embodiment would be similar to a sand paper abrading surface.

As shown in FIG. 3, a thin layer of flexible polyurethane 30 coats the surface of the jacket. This coating serves to bond the swath of steel bristles 28 to jacket 20 and to protect the integrity of the jacket surface from chemical cleaning agents and rough debris encountered during the cleaning process.

In FIG. *2b*, helical channel 32 is included in the surface of jacket 20 adjacent swath of steel bristles 24. The outside diameter of the channel is less than that of the interior diameter of casing 14. Referring to FIG. 1, the channel allows fluid circulating through the interior of the tool to flow between jacket surface 34 and casing wall 22 and to carry debris scoured from the casing wall to the surface. In a preferred operating procedure, fluid flowing down center bore 37 of workstring 38 and through interior 40 of tool 16 returns up the outside of the tool. Alternatively, the downward flow can be on the outside of the tool, with the return path up the center bore of the workstring.

Tool 16 is connectable to workstring 38 by metal mandrel 42, shown in FIG. *2a*, which extends through sleeve 18. Mandrel 42 is threaded at both ends 44,46 for connection to workstring The mandrel has annular bore 48 for allowing fluid circulation through the interior of the tool. Metal locking collar 50 is affixed about end 44 of the mandrel. The collar locks sleeve to the mandrel with an engagement of male castlettes 52 on the sleeve and female castlettes 54 on the collar, preventing rotation of the sleeve with respect to the mandrel. End 55 of the sleeve abuts against a inner shoulder 56 of the collar. Referring to FIG. *2c*, metal top-sub 58 is threadably connected to the mandrel. As top-sub 58 tightens on threaded end 46 of the mandrel, end 60 of the sleeve abuts against inner shoulder 62 of the top-sub. Thus, the sleeve is prevented from translating with respect to the mandrel. The top-sub has annular bore 64 for allowing fluid circulation through the interior of tool 16. The top-sub has a second threadable opening 66 for connection to the workstring.

Referring to FIG. 4, tool 16 slides onto mandrel 42 until end 55 of the sleeve engages lock collar 50. Top-sub 58 then screws onto end 46 of the mandrel to the point where end 60 of the sleeve firmly abuts against shoulder 62 of the top-sub. The tool is then affixed to the mandrel for insertion into the workstring.

Although only one cleaning tool has been shown and described, more than one cleaning tool can be stacked together if desired. Alternatively, cleaning tools can be spaced along the workstring, as desired.

It should be further noted that the sleeve and jacket assembly described can be sold as a unit apart from the mandrel to which the assembly is attached.

A preferred cleaning method will now be described as shown in FIG. 1. One or more cleaning tool, as illustrated in the foregoing description, are affixed to the workstring. The workstring drives the cleaning tools under mechanical force down through the casing until scouring has been effected to the desired depth. As the cleaning tools are being forced through the casing, fluid is circulated down the interior of the workstring, and through the interior of the tool. The fluid exits at the bottom of the workstring and flows through the helical channel on the exterior of the tools to the surface removing debris scoured from the casing wall. The cleaning process continues as the tools are retrieved to the surface executing a second scouring of the casing wall. The tools may be rotated during the cleaning process by the workstring to facilitate a more thorough scouring of the casing wall. Chemical cleaning solvents may also be used to assist the cleaning process by injecting the chemicals into the circulating fluid.

While several embodiments of the cleaning tool and methods for its use have been described and illustrated, it will be understood that the invention is not limited thereto, since many modifications may be made and will become apparent to those skilled in the art.

What is claimed is:

1. A well cleaning tool connectable to a workstring for scouring debris from the interior wall of a casing, comprising:

an elongated, generally cylindrical member having a bore therethrough adaptable for connection to the workstring, said member having side walls that are resiliently compressible to allow insertion into the casing and to exert a radially outward pressure against the interior wall of the casing without inflation, said member having an outside diameter larger than the inside diameter of the casing; and a helical swath of scratching elements affixed in said side walls forming a scouring surface positioned for contacting the interior wall of the casing, said side walls also including a helical channel adjacent said swath of scratching elements such as to allow fluid to circulate either downwardly through the bore of said member and upwardly between said member and the interior wall of the casing, or downwardly between said member and the interior wall of the casing and upwardly through the bore of the member, so as to carry to the surface the loosened debris scoured from the interior wall of the casing.

2. A well cleaning tool in accordance with claim 1, wherein said tool additionally comprises a rigid sleeve on the inner side of the walls of the member.

3. A well cleaning tool connectable to a workstring for scouring debris from the interior wall of a casing, comprising:

an elongated, generally cylindrical rigid sleeve adaptable for connection to the workstring;

a resilient jacket surrounding said sleeve, said jacket constructed of material that is resiliently compressible to allow insertion into the casing and to exert a radially outward pressure against the interior wall of the casing without inflation, said jacket having an outside diameter larger than the inside diameter of the casing; and a helical swath of scratching elements affixed in said jacket forming a scouring surface positioned for contacting the interior wall of the casing, said jacket also including a helical channel adjacent said swath of scratching elements such as to allow fluid to circulate either downwardly through the bore of said sleeve and upwardly between said jacket and the interior wall of the casing, or downwardly between said member and the interior wall of the casing and upwardly through the bore of the member, so as to carry to the surface the loosened debris scoured from the interior wall of the casing.

4. A well cleaning tool in accordance with claim 3, wherein said jacket includes solid foam.

5. A well cleaning tool in accordance with claim 3, wherein said sleeve is selected from the group comprising metal, kevlar, and plastic.

6. A well cleaning tool in accordance with claim 3, where in said tool includes a flexible exterior coating covering said jacket for binding said swath of scratching elements to said jacket.

7. A well cleaning tool in accordance with claim 6, wherein said coating is a chemical resistant polymer.

8. A well cleaning tool in accordance with claim 3, wherein said helical swath of scratching elements includes a fabric backing strip, and a plurality of individual steel bristles inserted in said fabric backing strip.

9. A well cleaning tool connectable to a workstring for scouring debris from the interior wall of a casing, comprising:

an elongated, generally cylindrical rigid sleeve;

a resilient jacket surrounding said sleeve, said jacket constructed of material that is resiliently compressible to allow insertion into the casing and to exert a radially outward pressure against the interior wall of the casing, said jacket having an outside diameter larger than the inside diameter of the casing;

a helical swath of scratching elements affixed in said jacket forming a scouring surface positioned for contacting the interior wall of the casing, said jacket including a helical channel adjacent said swath of scratching elements such as to allow fluid circulating through said sleeve to flow between said jacket and the interior wall of the casing and to carry to the surface the loosened debris scoured from the interior wall of the casing;

a mandrel extending through said sleeve adaptable for connection to the workstring;

a locking collar affixed to a first end of said mandrel and to a first end of said sleeve for ensuring-that said sleeve does not rotate with respect to said mandrel; and a top-sub affixed to a second end of said mandrel and to a second end of said sleeve for ensuring that said sleeve does not translate with respect to said mandrel.

10. A well cleaning tool in accordance with claim 9, wherein said jacket includes solid foam.

11. A well cleaning tool in accordance with claim 9, wherein said sleeve is selected from the group comprising metal, kevlar, and plastic.

12. A well cleaning tool in accordance with claim 9, where in said tool includes a flexible exterior coating covering said jacket for binding said swath of scratching elements to said jacket.

13. A well cleaning tool in accordance with claim 12, wherein said coating is a chemical resistant polymer.

14. A well cleaning tool in accordance with claim 9, wherein said helical swath of scratching elements includes a fabric backing strip, and a plurality of individual steel bristles inserted in said fabric backing strip.

15. A well cleaning tool in accordance with claim 9, wherein said mandrel is threaded on both ends for connection to the workstring, said mandrel having an annular bore for allowing fluid circulation through its interior.

16. A well cleaning tool in accordance with claim 9, wherein said locking collar is affixed about the first end of said mandrel and locked into the first end of said sleeve for ensuring that said sleeve does not rotate with respect to said mandrel.

17. A well cleaning tool in accordance with claim 9, wherein said top-sub is threadably connected to the second end of said mandrel and abutting against the second end of said sleeve for ensuring that said sleeve does not translate with respect to said mandrel.

18. A well cleaning tool connectable to a workstring for scouring debris from the interior wall of a casing, comprising:

an elongated, cylindrical metal sleeve;

a foam jacket surrounding said sleeve, said jacket constructed of foam that is resiliently compressible to allow insertion into the casing and to exert a radially outward pressure against the interior wall of the casing, said jacket having an outside diameter larger than the inside diameter of the casing;

a helical swath of a fabric backing strip mounted on said jacket;

a plurality of individual steel bristles inserted in said fabric backing strip positioned for contacting the interior wall of the casing;

a helical channel adjacent said swath of steel bristles such as to allow fluid circulating through the well cleaning tool to flow between said jacket and the interior wall of the casing and to carry to the surface the loosened debris scoured from the interior wall of the casing;

a flexible polyurethane exterior coating covering said jacket for binding said swath of steel bristles to said jacket;

a mandrel extending through said sleeve, having both ends threaded for connection to the workstring, said mandrel having an annular bore for allowing fluid circulation through its interior;

a locking collar affixed about a first end of said mandrel and locked into a first end of said sleeve for ensuring that said sleeve does not rotate with respect to said mandrel; and a top-sub threadably connected to a second end of said mandrel and abutting against a second end of said sleeve for ensuring that said sleeve does not translate with respect to said mandrel.

19. A method for cleaning the interior wall of a casing comprising steps of providing a well cleaning tool with an interior central bore attached to a workstring and having a plurality of helically arranged scratching elements mounted on a compressible material thereby resiliently contacting the interior wall of the casing without inflation, said tool having a channel for fluid circulation between the helical turns of the scratching elements;

displacing said cleaning tool through the casing to scour the casing wall with said swath of scratching elements; and circulating fluid either downwardly through the interior of said central bore of said cleaning tool and upwardly between said channel and casing wall or downwardly between the casing wall and the channel and upwardly through the bore to carry to the surface the loosened debris scoured from the interior wall of the casing.

20. A method for cleaning the interior wall of a casing in accordance with claim 19 including employing at least one additional cleaning tool along said workstring to facilitate a more extensive cleaning of the interior wall of the casing.

21. A method for cleaning the interior wall of a casing in accordance with claim 19 including applying chemical cleaning solvents to the interior wall of the casing to assist in the scouring of the interior wall of the casing by said cleaning tool.

* * * * *